United States Patent [19]

Viswanadham

[11] Patent Number: 4,556,424

[45] Date of Patent: Dec. 3, 1985

[54] CERMETS HAVING TRANSFORMATION-TOUGHENING PROPERTIES AND METHOD OF HEAT-TREATING TO IMPROVE SUCH PROPERTIES

[75] Inventor: Ramamurthy K. Viswanadham, Houston, Tex.

[73] Assignee: Reed Rock Bit Company, Houston, Tex.

[21] Appl. No.: 541,754

[22] Filed: Oct. 13, 1983

[51] Int. Cl.[4] ..... C22C 38/04; C22C 38/08; C22C 38/18

[52] U.S. Cl. ..... 75/240; 75/236; 419/14; 419/18

[58] Field of Search ..... 75/236, 240, 252; 419/14, 18

[56] References Cited

U.S. PATENT DOCUMENTS

| | | | |
|---|---|---|---|
| 2,731,711 | 1/1956 | Lucas | 75/240 |
| 3,369,891 | 2/1968 | Tarkan et al. | 75/236 |
| 3,859,085 | 1/1975 | Kimura et al. | 419/18 |
| 4,180,401 | 12/1979 | Frehn | 75/236 |
| 4,410,490 | 10/1983 | Ray et al. | 419/16 |

*Primary Examiner*—Allan M. Lieberman
*Attorney, Agent, or Firm*—Carl A. Rowold

[57] ABSTRACT

A powder metallurgy composite material comprising grains of a relatively hard material and a binder for binding the grains together, the binder being metastable and transformable at ambient temperature by the application of mechanical force from an initial state in which the major phase of the binder is austentic to a second state in which the major phase of the binder is martensitic, whereby the binder, while undergoing this transformation, absorbs mechanical energy applied to the composite material for increasing its fracture toughness and resistance to fatigue crack nucleation and propagation. Also disclosed is a method of heat-treating the composite materials to improve their transformation-toughening characteristics. A heat-treatable composite material having such improved transformation-toughening properties is also disclosed.

15 Claims, 8 Drawing Figures

CERMETS HAVING TRANSFORMATION-TOUGHENING PROPERTIES AND METHOD OF HEAT-TREATING TO IMPROVE SUCH PROPERTIES

BACKGROUND OF THE INVENTION

This invention relates to powder metallurgy composite materials of the type comprising grains of a relatively hard, abrasion resistant material, and a binder material for binding the grains together, and more particularly to a composite material having an improved binder exhibiting transformation-toughening properties. This invention also involves a method of heat-treating the composite material to improve its transformation-toughening properties, and a heat-treatable composite material having such improved transformation-toughening properties.

This invention involves an improvement over powder metallurgy composite materials of the type, such as that disclosed for example in U.S. Pat. No. 2,731,711, comprising grains of relatively hard, abrasion resistant material, such as tungsten carbide, and a binder material, such as a cobalt alloy, for binding the grains together. Such composite material, which is also referred to as a "cemented carbide" or more simply a "cermet", is widely used for cutting tools and as the cutting elements or so-called "inserts" for rolling cutter drill bits such as shown in U.S. Pat. No. 2,687,875, for use in drilling oil and gas wells.

While tungsten carbide with a cobalt alloy binder has been the standard composite material for use in inserts in the drill bit manufacturing industry for the past 30 years, this material (and more particularly the cobalt binder therefor) presents several significant disadvantages. Because cobalt is principally mined outside of the United States and has significant strategic importance militarily, the supply of cobalt to the United States drill bit manufacturing industry is vulnerable to disruptions and shortages. Moreover, because of the relatively small quantity of cobalt mined each year, the price of cobalt is subject to dramatic escalations during periods of high demand, such as occurred during the late 1970's. In addition, excessive wear and breakage of inserts, which reduce the useful life of drill bits, is attributable to the failure of the cobalt binder to hold the tungsten carbide grains together under the relatively high compressive loads (which may exceed 60,000 pounds) applied to the drill bit during drilling operations. More particularly, the limiting factor in the wear and life of drill bit inserts formed of conventional cermet material is the lack of adequate fracture toughness and resistance to fatigue crack growth, of the inserts made with a cobalt binder.

SUMMARY OF THE INVENTION

Among the several objects of this invention may be noted the provision of a powder metallurgy composite material having an improved binder material; the provision of such a composite material having a binder which is capable of transformation-toughening for improved mechanical properties; the provision of such a composite material having greater fracture toughness and resistance to fatigue crack nucleation and propagation than conventional composite materials; the provision of such a composite material, which as formed into an insert for a drill bit, offers greater resistance to wear and breakage than conventional cermet materials for extended insert life; the provision of such a composite material having a binder formed of materials which are relatively inexpensive and available domestically in abundant supply; and the provision of a method of heat-treating cermets to improve transformation-toughening properties.

The powder metallurgy composite material of this invention comprises grains of a relatively hard, abrasion resistant material, and a binder material for binding said grains together, the binder material being metastable and transformable at ambient temperature by the application of mechanical force of at least a predetermined magnitude from an initial state in which the major phase of the binder material is austentic to a second state in which the major phase of the binder material is martensitic, whereby the binder material, while undergoing this transformation, absorbs mechanical energy applied to the composite material for increasing its fracture toughness and its resistance to fatigue crack nucleation and propagation.

A heat-treatable powder metallurgy composite material of this invention comprises grains of a relatively hard, abrasion resistant material, and a binder material for binding the grains together, with the binder being metastable and transformable, upon being cooled to a transformation temperature below ambient temperature, from an initial state in which the major phase of the binder material is austenitic to a second state in which the major phase of the binder material is martensitic, the transformation causing deformation of the binder material due to volume changes and shear. The cooled binder material, upon being heated to a temperature above said transformation temperature reverting to a state in which the major phase of the binder material is austenitic, with the reverted austenite retaining at least some measure of said deformation and enhancing the stress-induced transformation characteristics of the binder and thereby the fracture toughness and resistance to fatigue crack nucleation and propagation of the composite material.

The method of this invention of heat treating heat-treatable powder metallurgy composite material of the above-described type comprises the steps of cooling the composite material to a temperature at least as low as the transformation temperature to transform the binder material to its second state and to cause deformation of the binder material, thereafter heating the composite material to a temperature above ambient to cause the binder material to revert while retaining at least some measure of said deformation, and thereafter quenching the composite material to ambient temperature.

Other objects and features will be in part apparent and in part pointed out hereinafter.

DESCRIPTION OF THE PREFERRED EMBODIMENTS

Figure 1:
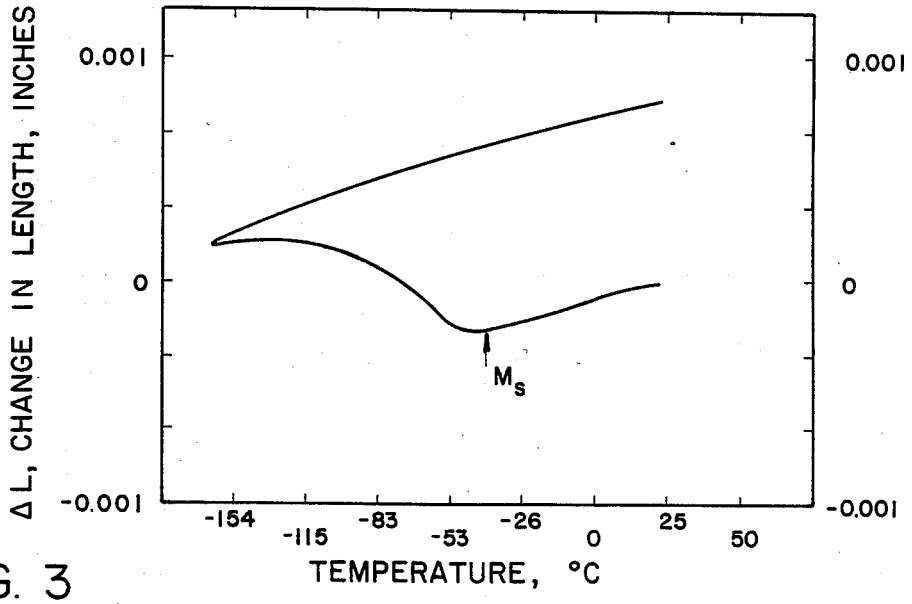
FIG. 1 is a graphical representation of the changes in length of a sample of a powder metallurgy composite material of this invention as function of temperature, showing the expansion of the material due to its transformation from austensite to martensite when cooled to temperatures below the martensite transformation start temperature, Ms.

The powder metallurgy composite material of this invention comprises grains of a relatively hard, abrasion resistant material, and a binder material for binding the grains together. The hard, abrasion resistant material is a transition metal compound, preferably a transition metal carbide. The composite material thus may be referred to as a "cemented carbide" or a so-called "cermet". The bindder material is an alloy of iron, and preferably an alloy of iron, carbon and at least one element from the group of elements comprising nickel, manganese, aluminum and chromium. Key to this invention is the fact that the binder material has so-called "transformation-toughening" properties, which will be described in detail hereinafter.

While the cermet of this invention is contemplated to have numerous uses such as for cutting tools and bearing assemblies, including bearing assemblies for rotary drill bits, its present preferred use is as cutting elements or inserts for a roller cutter drill bit. Accordingly, to facilitate the discussion of the cermet of this invention and give the most complete and detailed description of the preferred embodiments of the cermet, the cermet will be considered hereinafter as it is used in the form of inserts for rotary drill bits. With the cermet of this invention so used, the hard, abrasion resistant material preferably comprises tungsten carbide, and the binder material preferably comprises an alloy of iron, carbon and nickel. Since iron is the principal constituent of the binder, the binder is commonly referred as an iron-based binder or more simply an iron binder to distinguish it from the cobalt alloy binder (or cobalt binder) of the conventional cermet material for inserts for drill bits.

The concept of "transformation-toughening" has been used in the past with certain select steels (i.e., steels of certain compositions and subject to certain heat-treatment processes) to improve their fracture toughness. Basically, the concept involves the transformation of the steel from an initial austenitic state to a subsequent martensitic state at ambient temperature upon application of mechanical energy to the steel, with a resultant absorption of mechanical energy by the steel during its transformation. This property of steel to absorb mechanical energy at ambient temperature, such as the energy generated by normal working loads applied to steel, increases the steel's fracture toughness and resistance to fatigue crack nucleation and propagation, as described more fully hereinafter.

In order to have "transformation-toughening" properties, a steel must have a martensite start temperature, Ms, (i.e., the temperature at which the steel when cooled begins to transform from its initial austenitic state to a subsequent martensitic state) below ambient temperature, so that, at ambient temperature, mechanical energy may be the driving force used to cause the steel to transform. However, the Ms of the steel should not be so far below ambient temperature that the steel will become stable in an austenitic state at ambient temperature regardless of the application of normal working loads to the steel (i.e., too stable to transform). In this later regard, the steel thus also should have a so-called deformation-induced transformation temperature Md (i.e., the temperature at which application of mechanical energy will cause the steel to begin to transform from austenite to martensite) above ambient temperature.

In contrast to the above-described "transformation-toughening" steels, commonly used steels, such as AISI 1020, 1040 and 1065 for example, do not have "transformation-toughening" properties. The Ms, as well as, the martensite finish temperature, Mf (i.e., the temperature at which the transformation to martensite is complete) of these steels is well above ambient temperature. Thus, at ambient temperature, these steels are already completely transformed to martensite and hence incapable of further transformation to martensite upon the application of mechanical force.

The key to "transformation-toughening" in steel is then to suppress the temperature-induced martensitic transformation, thereby enabling the steel to undergo a deformation-induced martensitic transformation in response to mechanical loads applied to the steel at ambient temperature. Because the points of greatest stress or deformation in a steel body subject to a load are in the stress fields of nucleating and propagating cracks, the points at which the deformation-induced martensitic transformation will occur, will also be in the stress fields of the cracks. This positioning of the martensitic transformation in the crack stress fields has the highly desireable result that at least a portion of the mechanical energy causing the cracks to form and propagate is absorbed or dissipated in inducing the martensitic transformation, thereby slowing the formation and propagation of these cracks. Thus "transformation-toughening" steels, as compared to to similar steels without this property, have increased resistance to crack nucleation and propagation, as well as, increased fatigue strength and fracture toughness.

Heretofore, the concept of "transformation-toughening" has not been used in powder metallurgy composite materials (e.g., cermets). In deed, it is believed that heretofore there has not even been a recognition that it would be possible to use this concept in such materials, much less that utilization of the concept could markedly improve the mechanical properties of such materials. This is likely due to the fact that the physical and metallurgical differences between steel and cermets are so great that these materials are studied more or less independently of each other.

However, at the same time, many of the properties of the constituent materials of cermets observed when the materials are not used in a cermet cannot be applied to these same materials when they are used in a cermet. For example, certain observed properties of a binder material, per se, do not hold true for the binder material as used in a cermet. This is due, in part, to the constraint imposed on binder deformation by surrounding grains of hard material, such as tungsten carbide, and the elastic and thermal mismatch strains between the grains and the binder.

In the development of the improved cermet of this invention for use as inserts for rotary drill bits, it was concluded that tungsten carbide was the best material to be used as the hard phase of the cermet because of its ready availability, high cleavage energy and high elastic modulus. It was further concluded that any significant improvements in the mechanical properties of cermets would be the result of improvements in the mechanical properties of the binder. More particularly, it was concluded that improvements in the cermet for inserts would be the result of improvements in the binder's role in controlling the fracture toughness and resistance to fatigue crack nucleation and propagation, of the insert. In addition to these mechanical strength properties, it was recognized that any new binder (like the conventional cobalt binder) must also be able to wet carbide, have solubility for both tungsten and carbon, form a liquid at a temperature which could be achieved in conventional sintering and hot isostatic press ovens, be a non-carbide former, and not permit intermetallic compounds to be formed at the carbide/binder interface. The metals from group VIII of the periodic table satisfy these above-described requirements to varying degrees.

In attempting to identify an improved binder which could meet all these requirements, the idea was conceived that it may be possible to formulate a metal alloy binder having "transforming-toughening" properties. Extensive testing was then conducted to verify that this idea was in fact feasible and to identify specific compositions of group VIII metals having "transformation-toughening" properties and which would otherwise be suitable as a binder for cermets for inserts. As a result of the testing, improved binder were in fact found. As described previously, these binders preferably comprise alloys of iron, nickel and carbon. More particularly, the binder should comprise approximately 73 to 83 weight percent iron, 16 to 26 weight percent nickel and 0.45 to 1.4 weight percent carbon.

Among the tests conducted to identify improved binder materials (and more particularly improved cermets using such binders) having "transformation-toughening" properties, were tests to confirm that a given binder material had an initial state in which its major phase was austenitic and a second state in which its major phase was martensitic, and that the material had a martensite start temperature, Ms, below ambient temperature. FIG. 1 illustrates in graphical form the results of one such test conducted on a cylindrical sample of cermet having tungsten carbide grains and a binder comprising 77 weight percent iron, 22 weight percent nickel and 1.0 weight percent carbon. In this test, the thermal expansion of the sample was observed by measuring the change in length of the sample as a function of temperature.

In FIG. 1, the thermal expansion of the sample is shown to follow a curve having a lower reach representing the change in length of the sample upon cooling the sample, and an upper reach representing the change in length upon reheating the cooled sample. As will be observed from FIG. 1, upon cooling the sample from approximately +25° C., the sample contracts more or less linearly until the temperature drops to about −40° C. Cooling the sample beyond −40° C., however, resulted in expansion of the sample, inicating that the binder was undergoing a transformation from austenite to martensite, which is of lower density. The expansion due to transformation to martensite continued upon further cooling until the temperature dropped to approximately −130° C., at which point the transformation was nearing completion. Cooling beyond this point, resulted in contraction of the sample. It was thus concluded that the martensite start temperature for the binder of this cermet designated Ms in FIG. 1, is approximately −40° C., and thus is well below ambient temperature, as required for "transformation-toughening". The upper reach of the curve in FIG. 1 shows that the sample expanded more or less linearly when reheated to ambient temperature.

Figure 2A:
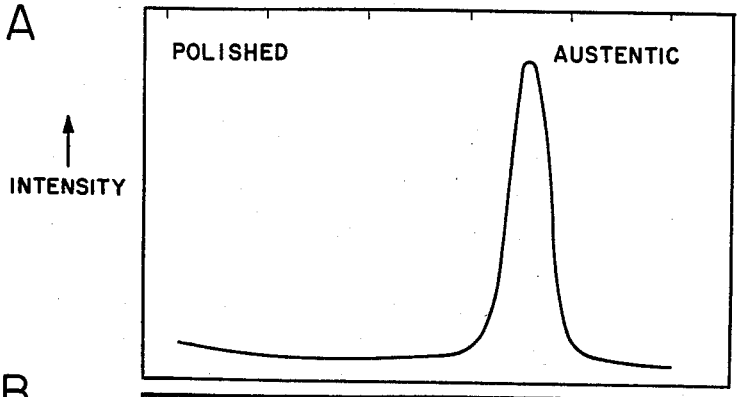
FIG. 2A is an X-ray diffraction pattern from a polished surface of a sample of a composite material of this invention, showing the major phase of the material to be austenitic.
Figure 2B:
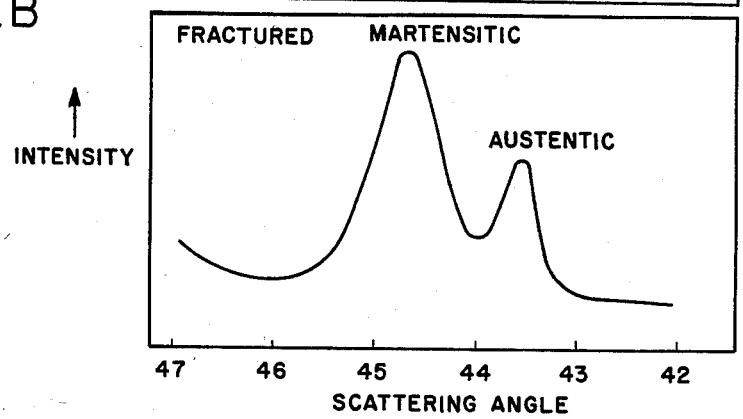
FIG. 2B is an X-ray diffraction pattern from the fracture surface of a sample similar to that shown in FIG. 2A but which has been fractured, showing the major phase of the fractured material to be martensitic.

Tests were also conducted to confirm that the binder material would experience martensitic transformation at ambient temperature upon application of mechanical force. Referring to FIGS. 2A and 2B, there is illustrated the X-ray diffraction patterns taken from surfaces of first and second samples, respectively, of a cermet similar to that used in the FIG. 1 testing. The first sample had a polished surface from which the X-ray diffraction pattern was taken. The second sample had been subjected to fracture at ambient temperature and presented a fracture surface on the plane of fracture from which the X-ray diffraction pattern was taken. As illustrated in FIG. 2A, in the initial state of the binder of the cermet (i.e., its state prior to fracture), the major phase of the binder was austenitic, as is designated by "A" in FIG. 2A. As illustrated in FIG. 2B, in the second state of the binder material (i.e., its state upon fracture of the cermet and thus upon undergoing maximum deformation), the major phase of the binder was substantially martensitic, designated M. Thus, this cermet was found to have a deformation-induced temperature Md above ambient temperature, as is required for "transformation-toughening". Because of the range of ambient temperatures to which inserts and the drill bits to which they are secured, may be exposed during use, "transformation-toughening" cermets for inserts should have an Ms below 0° C. and an Md above 50° C.

Having once established that iron, nickel and carbon alloy binders have the properties necessary for "transformation-toughening", it was necessary to conduct tests to establish that these binders offer superior mechanical properties as compared to conventional cermets, and to find those binder compositions offering the best performance. In this latter regard, it was found the iron and nickel contents of the binder could be varied relatively widely (e.g., between 73 to 83 weight percent iron and between 16 to 26 weight percent nickel) and a satisfactory binder could still be formed. However, it was also found that carbon content was critical and was a function of nickel content.

Figure 3:
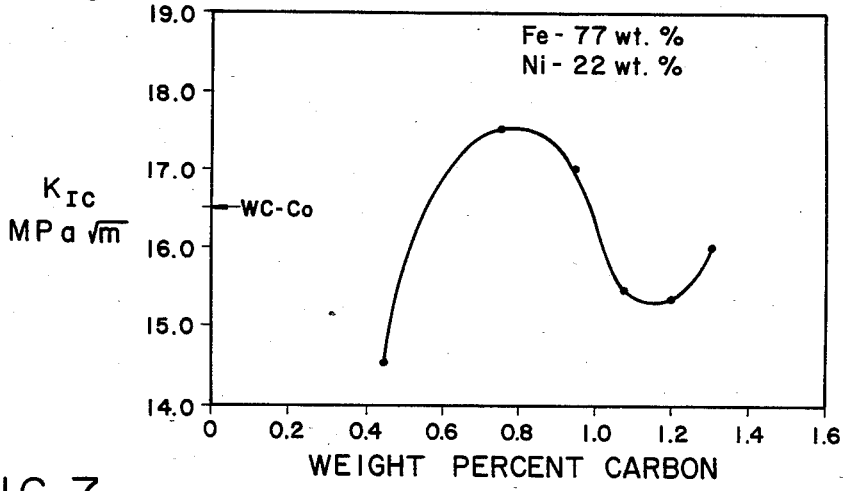
FIG. 3 is a graphical representation of the fracture toughness, as measured by the critical stress intensity factor $K_{IC}$ for a composite material of this invention as a function of the weight percent of carbon in the material.

FIG. 3 illustrates the results of laboratory tests conducted on a series of different cermets, each having a binder comprising approximately 77 weight percent iron and approximately 22 weight percent nickel but different carbon contents. In this test, the critical stress intensity factor $K_{IC}$, which is a measure of fracture toughness, was measured for "short-rod" specimens of the different cermets. As shown in FIG. 3, the fracture toughness of these cermets reached a maximum when the carbon content was approximately 0.8 weight percent. At carbon contents less than 0.8 weight percent, the binder, in its initial state, was not fully austenitic (i.e., some portion of the binder was martensitic) and thus not all of the binder could undergo martensitic transformation. At carbon contents in excess of 0.8 weight percent, the binder exhibited a tendency to form a stable phase of austenite incapable of transformation. Thus, upon increasing carbon content of the binder material beyond 0.8 weight percent, the amount of metastable austenitic binder available for transformation again decreased. Also shown in FIG. 3, is the maximum fracture toughness of conventional cermet having a cobalt binder, designated WC-Co in FIG. 3. As will be observed from FIG. 3, certain compositions the iron binder cermets of this invention have greater fracture toughness than the conventional cermet.

Field tests were conducted to establish that the iron binder cermets of this invention which offered improved fracture toughness in laboratory tests, would also offer superior performance over conventional cermets in actual use. For these tests, inserts of longer than normal protrusion length (and thus more subject to fracture) were fabricated of four different cermets. One of the cermets was of conventional cermet composition having a cobalt binder, and the other three cermets were of cermet compositions of this invention having a binder comprising approximately 77 weight percent iron and 22 weight percent nickel but different carbon contents. One of these three cermets had 0.8 weight percent carbon, while the other two had 1.0 and 1.2 weight percent carbon, respectively. All four cermets, however, included the same amount and type of tungsten carbide material and were formed by the same conventional powder metallurgy manufacturing techniques such as those generally described in U.S. Pat. No. 2,781,711 involving sintering or hot isostatic pressing (i.e., hipping).

Figure 4:
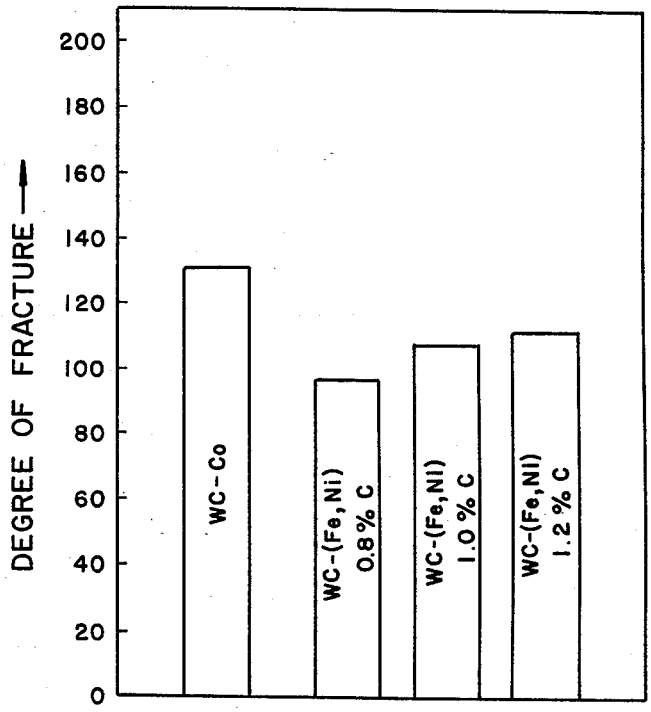
FIG. 4 is a graphical comparison of the degree of fracture experienced by inserts of conventional cermet and of three different compositions of the composite material of this invention mounted on a drill bit used to drill soft rock and hard ore formations.
Figure 5:
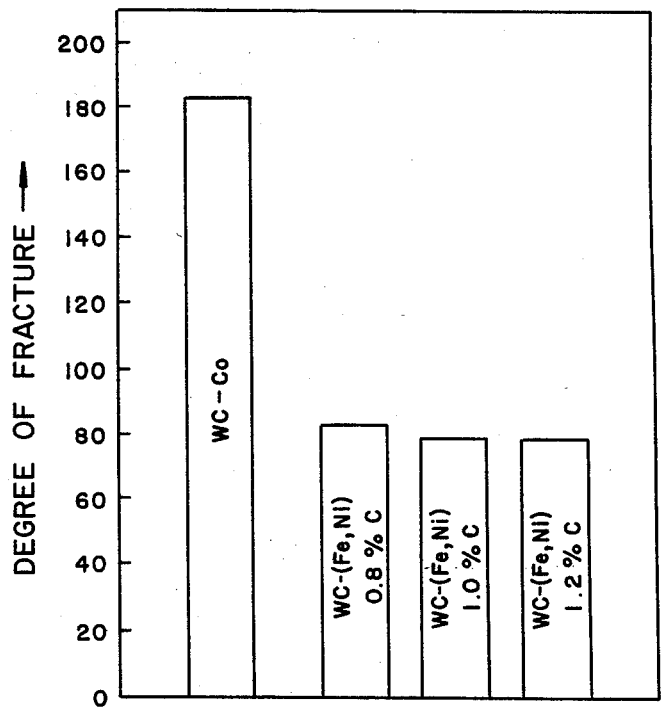
FIG. 5 is a graphical comparison of the degree of fracture experienced by inserts of conventional cermet and of three different compositions of the composite material of this invention mounted on a second drill bit used to drill only a hard ore formation.

Inserts of the four different cermets were secured in a equally distributed pattern in the insert bores or holes in two 12¼" diameter tri-cone rotary drill bits. The first of these bits was used to drill some 1256 feet of soft rock and hard ore, and the second bit used to drill some 485 feet of hard ore at the Griffith iron ore mine in Red Lake, Ontario. Drilling with both bits was done at 80 rpm with 100,000 pounds on the bit. After drilling, the bits were examined for insert fracture, with the inserts being given numerical ratings from 0 to 10 reflecting the volume of insert material lost due to fracture of the inserts. FIG. 4 illustrates the results of the test of the first bit. It shows that the conventional cermet, designated WC-Co, had the highest degree of fracture, (approximately 130) and the cermet comprising an iron binder having 0.8 percent weight percent carbon had the lowest degree of fracture, (approximately 95) with the other two cermets (i.e., those comprising binders having 1.0 and 1.2 weight percent carbon) having intermediate degrees of fracture. FIG. 5, illustrating the results of the test of the second bit, shows the conventional cermet to have a relatively high degree of fracture (approximately 185), while all of the iron binder cermets of this invention had about same relatively low degree of fracture (approximately 80). The similarity in degrees of fracture of the three iron binder cermets seems to be inconsistent with the laboratory test results of these cermets shown in FIG. 3. This may be due to the fact that the loading rate during field testing was found to be four orders of magnitude higher than in the laboratory testing.

As will be observed from the foregoing, through composition control it is thus possible to form improved cermets having "transformationtoughening" properties, which provides greater fracture toughness and resistance to fatigue crack nucleation and propagation than conventional cermets having a cobalt binder. However, to further enhance the "transformation-toughening" properties of these cermets "thermomechanical treatment" of iron binder cermets was investigated. "Thermomechanical treatment" practices have been used in the past with certain alloy systems to improve fracture toughness and, for such systems, involved a combination of mechanical working and suitable heat treatment of the alloy material. However, in cermets, mechanical working of a cermet to deform the binder cannot be effected without also cracking the tungsten carbide grains. Even if such cracking were permissible (which it is not), the level of strain which could be induced in the binder by mechanical working of the cermet would be insufficient to effect meaningful "thermomechanical treatment". Thus, initially, enhancement of iron binder cermets via conventional "thermomechanical treatment" practices did not appear possible. However, a modified treatment practice was conceived when it was recognized that the martensitic transformation of iron alloy binders occurring upon cooling the cermet to liquid nitrogen temperature involved large volume increases (approximately 3%), shear and shape strain. Under this treatment practice, the iron binder cermet is first cooled to liquid nitrogen temperature to effect significant deformation of the binder, and then heated above its austenite finish temperature to revert the binder to its original austenitic state. This practice was found to be highly effective in enhancing the binder's "transformation-toughening" properties, while having little or no effect on the carbide grains.

More particularly, in the heat-treating method of this invention, an iron binder cermet, manufactured in accordance with known power metallurgy techniques such as disclosed for example in U.S. Pat. No. 2,731,711, is immersed in a bath of liquid nitrogen and allowed to cool until temperature equilibrium occurs at about −196° C. As previously described, this cooling causes transformation of the binder to martensite, with the resultant deformation creating a large number of point defects, internal twins, faults and other dislocations in the binder. Thereafter, the cermet is removed, washed, dried and transferred to a molten salt bath, such as a chloride bath containing barium, sodium and potassium chlorides having an operating range of between 550° and 900° C. The salt bath provides rapid and uniform heating of the cermet. This rapid heating causes the binder rapidly to revert to its initial austenitic state, with insufficient time being available for the defects and dislocations previously formed to anneal out. After a suitable time in the salt bath, the cermet is removed and quenched in oil.

Figure 6:
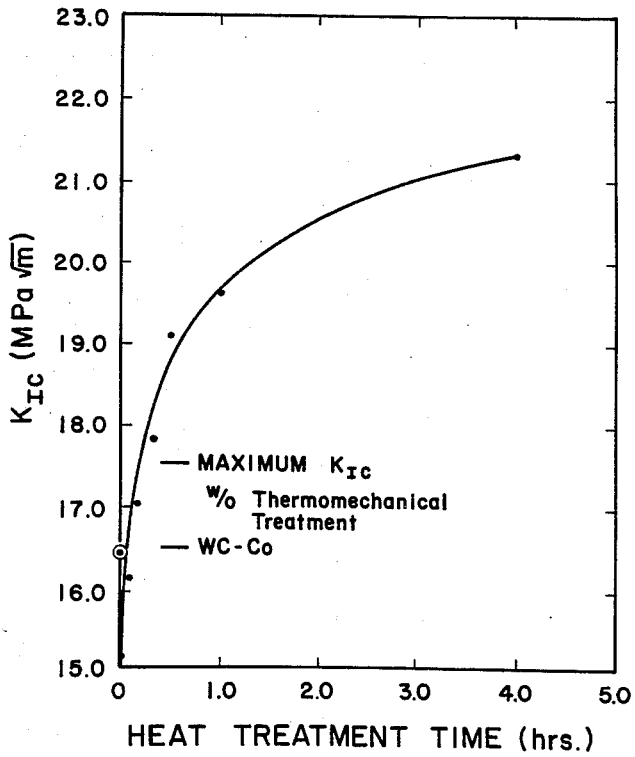
FIG. 6 is a graphical representation of the fracture toughness, as measured by the critical stress intensity factor $K_{IC}$, for a heat-treatable composite material of this invention as a function of heat treatment time.

It was found that the amount of time the cermet was allowed to soak in the salt bath, which is also referred to as "heat treatment time", had a significant affect on its "transformation-toughening" properties. Referring to FIG. 6, the fracture toughness $K_{IC}$ of a cermet comprising a binder having 77 weight percent iron, 22 weight percent nickel and 1.0 weight percent carbon is illustrated graphically as a function of "heat treatment time." As will be observed from FIG. 6, the fracture toughness of the cermet increased with heat treatment time, with the rate of increase in fracture toughness being relatively high for the first hour of treatment and decreasing thereafter. Also illustrated in FIG. 6 is the maximum fracture toughness of a similar iron binder cermet which was not subject to "thermomechanical treatment", designated Maximum $K_{IC}$ w/o "thermomechanical treatment." In addition, the maximum fracture toughness of a comparable conventional cobalt binder cermet designated "WC-Co.", is also shown in FIG. 6. A comparison of the fracture toughness of these three different cermets reveals that an iron binder cermet subject to heat treatment for one half hour or more has greater fracture toughness than the others.

Figure 7:
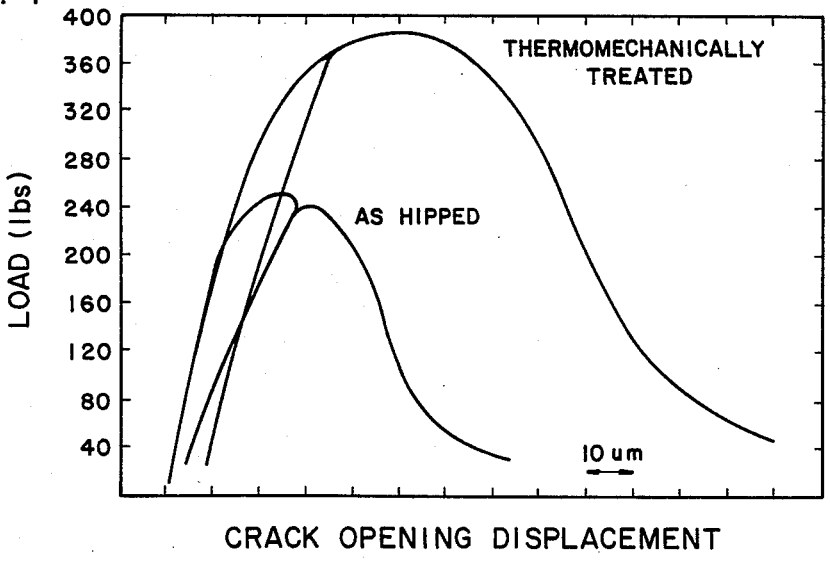
FIG. 7 is a graphical representation of the load applied to the mouth of two notched samples of heat-treatable composite material of this invention, one sample being heat-treated and the other not, as a function of the displacement of the openings at the mouths of the samples.

Other measures of the fracture behavior of iron binder cermets were found to be altered by "thermomechanicaltreatment." Referring to FIG. 7, there is illustrated the results of load tests conducted on two notched samples of an iron binder cermet having a composition similar to that of the cermet tested in FIG. 6. One sample was subject to thermomechanical treatment and the other was not (and thus remained in its as-sintered or as-hipped condition). In these tests, the notched samples were mounted in a testing fixture applying loads at opposite side of the mouths of the notches in the samples tending to cause the mouths to open. FIG. 7 illustrates the load-displacement curves relating the loads, as measured in pounds, applied across the mouths of the samples and the extent of mouth or crack opening displacement. As will be observed from FIG. 7, the thermomechanically treated cermet not only could support a significantly greater load at any given crack opening displacement but also could support loads at significantly greater crack opening displacements than the same cermet which was not subject to thermomechanical treatment, designated "As-Hipped" in FIG. 7. Moreover, the areas under the load-displacement curves in FIG. 7, which are measures of the energy dissipated in the fracture of the cermet, further establish that treated iron binder cermets are able to withstand significantly higher levels of mechanical energy prior to catastrophic failure than the same cermets without treatment.

The reasons for this dramatic improvement in the properties of iron binder cermets when thermomechanically treated are not fully understood. However, as indicated previously, it has been found that the steps of cooling the cermet to liquid nitrogen temperature and then reheating it to a temperature above the austenite finish temperature to revert the binder to austenite cause the formation of numerous dislocations in the binder of the cermet. Electron micrographs of iron binder cermets before and after treatment revealed that the discloations in the binder of treated cermets were not only more numerous but also more uniformly distributed and smaller than the dislocations in the binder of untreated cermet. In addition, it was found that during heat treatment of the cermet in the salt bath, excess carbon in the binder (i.e., carbon in excess of the minimum required to make the binder fully austenitic) tended to segregate to the dislocations, with the amount of carbon segregating being a function of time. Based on these observations, it was theorized that these small, uniformly distributed carbon-segregated regions restrict the size of deformation-induced martensite regions. This enables the martensitic transformation in the stress fields of nucleating and propagating cracks in a treated cermet to proceed earlier (under less stress), more gradually and more uniformly under a mechanical load than in untreated iron binder cermets, thereby enhancing the "transformation-toughening" properties of the cermet.

While the concepts of "transformation-toughening" and "thermomechanical treatment" are disclosed as having been used with cermets having grains of tungsten carbide and and iron, nickel and carbon alloy binder, it is contemplated that these concepts could be used with other powder metallurgy composite materials having grains of a transition metal compound and a binder comprising an alloy of iron. Moreover, while the composite material of this invention has been described as being used to form inserts for rotary drill bits, it is contemplated that the material could also be used in other applications, such as for bearing members of a bearing assembly.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A powder metallurgy composite material comprising grains of a relatively hard, abrasion resistant material consisting essentially of a transition metal compound, and a binder material for binding said grains together consisting essentially of iron, carbon, and at least one element selected from the group of nickel, manganese, aluminum, and chromium, said binder material being metastable and transformable at ambient temperature by the application of mechanical force of at least a predetermined magnitude from an initial state in which the major phase of the binder material is austenitic to a second state in which the major phase of the binder material is martensitic, whereby said binder material, while undergoing said transformation, absorbs mechanical energy applied to the composite material for increasing its fracture toughness and its resistance to fatigue crack nucleation and propagation.

2. A powder metallurgy composite material as set forth in claim 1 wherein said metastable binder material has a deformation-induced transformation temperature at which the binder material is transformable from its initial state to its second state upon the mechanical deformation of the composite material, and a thermally-induced transformation temperature at which the binder material is transformable from its initial state to its second state due only to the temperature and without the application of mechanical force to the composite material, the deformation-induced temperature being higher than the thermally-induced temperature.

3. A powder metallurgy composite material as set forth in claim 2 wherein said deformation-induced transformation temperature is above 50° C. and said thermally-induced transformation temperature is below 0° C.

4. A powder metallurgy composite material as set forth in claim 1 wherein said abrasion resistant material is a transition metal carbide.

5. A powder metallurgy composite material as set forth in claim 4 wherein said abrasion resistant material is tungsten carbide.

6. A powder metallurgy composite material as set forth in claim 1 wherein said binder material is an alloy of iron, carbon and nickel.

7. A heat-treatable powder metallurgy composite material comprising grains of a relatively hard, abrasion resistant material consisting essentially of a transition metal compound, and a binder material for binding said grains together consisting essentially of iron, carbon, and at least one element selected from the group of nickel, mangenese, aluminum, and chromium, said binder material being metastable and transformable, upon being cooled to a transformation temperature below ambient temperature, from an initial state in which the major phase of the binder material is austenitic to a second state in which the major phase of the binder material is martensitic, said transformation causing deformation of the binder material and the formation of dislocations therein due to volume changes and shear, said cooled binder material, upon being heated to a temperature above said transformation temperature reverting to a state in which the major phase of the binder material is austenitic, said reverted austenite retaining at least some measure of said deformation and dislocations and enhancing the fracture toughness and resistance to fatigue crack nucleation and propagation of the composite material.

8. A powder metallurgy composite material as set forth in claim 7 wherein said abrasion resistant material is a transition metal carbide.

9. A powder metallurgy composite material as set forth in claim 8 wherein said abrasion resistant material is tungsten carbide.

10. A powder metallurgy composite material as set forth in claim 7 wherein said binder material is an alloy of iron, carbon and nickel.

11. A method of heat treating a powder metallurgy composite material comprising grains of a relatively hard, abrasion resistant material consisting essentially of a transition metal compound, and a binder material for binding said grains together consisting essentially of iron, carbon, and at least one element selected from the group of nickel, manganese, aluminum, and chromium, said binder material being metastable and transformable, upon being cooled to a transformation temperature below ambient temperature, from an initial austenitic state in which the major phase of the binder is austenitic to a second martensitic state in which the major phase of the binder is martensitic, said transformation causing deformation of the binder material and the formation of dislocations therein due to volume changes and shear, said cooled binder material, upon being heated to a temperature above said transformation temperature, reverting to an austenitic state in which the major phase of the binder material is austenitic, said reverted austenite retaining at least some measure of said deformation and dislocations and enhancing the fracture toughness and resistance to fatigue crack nucleation and propagation of the composite material, the method comprising the steps of:

(a) cooling the composite material to a temperature at least as low as said transformation temperature and below approximately −100° C. to transform the binder material to its said second martensitic state and to cause deformation of the binder material;

(b) then heating the composite material to a temperature above approximately +400° C. to cause the binder material to revert to an austenitic state while retaining at least some measure of said deformation; and (c) then cooling the composite material to ambient temperature.

12. The heat treating method of claim 11 wherein the composite material is heated at said temperature above approximately +400° C. for at least one hour.

13. A powder metallurgy composite material comprising grains of a relatively hard, abrasion resistant material consisting essentially of a transition metal compound and a metastable binder material for binding said grains together, said binder material consisting essentially of iron, carbon, and at least one element selected from the group of nickel, manganese, aluminum, and chromium, the carbon content of said binder material being between about 0.45 percent and about 1.4 percent by weight;

said metastable binder material being transformable from an initial state in which the major phase of the binder material is austenitic to a second state in which the major phase of the binder material is martensitic, said binder material while undergoing said transformation absorbing mechanical energy applied to the composite material for increasing its toughness.

14. A composite material comprising grains of tungsten carbide and a metastable binder material for binding said grains together, said metastable binder material consisting essentially of iron, carbon, and at least one element selected from the group of nickel, manganese, aluminum, and chromium, the carbon content of said binder material being between 0.45 percent and about 1.4 percent by weight;

said metastable binder material being transformable from an initial austenitic state in which the major phase of the binder material is austenitic to a second martensitic state in which the major phase of the binder material is martensitic, said metastable binder material having a deformation-induced transformation temperature above ambient at which it is transformable from its initial austenitic state to said second martensitic state upon a mechanical deformation of the composite material, and a thermally-induced transformation temperature below ambient at which the binder material is transformable from its initial austenitic state to said second martensitic state without any application of mechanical force.

15. The composite material as set forth in claim 14 in which said binder material is an alloy of iron, carbon, and nickel, said binder material comprising approximately 73 to 83 percent iron by weight, and approximately 16 to 26 percent nickel by weight.

* * * * *